United States Patent [19]

Reidenbach

[11] 4,370,795

[45] Feb. 1, 1983

[54] APPARATUS AND METHODS TO PROVIDE SHORING DURING THE MANUFACTURING OF A REEFER CONTAINER

[75] Inventor: Robert B. Reidenbach, Honeybrook, Pa.

[73] Assignee: The Budd Company, Troy, Mich.

[21] Appl. No.: 209,545

[22] Filed: Nov. 24, 1980

[51] Int. Cl.[3] ..... B29D 23/00

[52] U.S. Cl. ..... 29/559; 29/455 R; 269/48.1; 269/287; 425/110; 264/46.5

[58] Field of Search ..... 425/110, 468, 441; 29/559, 455 R; 249/63; 269/287, 48.1, 50, 111; 264/46.5

[56] References Cited

U.S. PATENT DOCUMENTS

| | | | |
|---|---|---|---|
| 1,052,557 | 2/1913 | Barber | 249/63 |
| 1,810,583 | 6/1931 | Tuerck | 425/468 |
| 2,547,946 | 4/1951 | Jessen | 425/468 |
| 2,708,782 | 5/1955 | Jessen | 425/468 |
| 2,870,518 | 1/1959 | Bössner | 425/468 |
| 3,155,751 | 11/1964 | Morris | 264/46.5 |
| 3,780,976 | 12/1973 | Messier | 249/63 |
| 3,880,415 | 4/1975 | Fujioka et al. | 269/48.1 |

*Primary Examiner*—Daniel C. Crane

*Attorney, Agent, or Firm*—Edward M. Farrell; Herman Foster; Thomas I. Davenport

[57] ABSTRACT

A first set of selectively movable platens are disposed at a fixed station to receive a container therein to provide shoring of the external surfaces of the container. A second set of selectively movable platens to provide shoring of the internal surfaces of the container are attached to a movable assembly which is normally disposed on a support platform at a second station. The assembly is selectively moved off and on the support platform in and out of the container to bring the second set of platens into alignment with the interior surfaces of the container.

8 Claims, 5 Drawing Figures

APPARATUS AND METHODS TO PROVIDE SHORING DURING THE MANUFACTURING OF A REEFER CONTAINER

BACKGROUND OF THE INVENTION

So called "reefer containers" or refrigerated insulated intermodule containers, which may form parts of trailers, are well known. Generally, areas between the inner and outer surfaces of the roof and side walls of the reefer form cavities to receive foaming material which provides the insulation. The foaming material may comprise liquid chemicals which react to form a quasisolid mass of air cells.

During the foaming operation, the inner and outer surfaces of the roof and side walls of the container must be shored. The shoring elements comprise platens or other restraining devices used to prevent bulging of the container surfaces during expansion of the foaming material which is inserted into the cavities under very high pressures.

The shoring elements or platens generally comprise sheets of rigid material such as plywood sheets which cover wide areas to provide pressure or resistance to prevent expansion of the surfaces of the container being contacted. Holes in the reefer unit container are adapted to be connected to discharge tubes of the foam chemical metering head to receive the foaming material under high pressure.

One present arrangement of shoring involves the installation of internal shoring elements by a group of workers who install the shoring equipment into the unit or container. The shoring equipment may comprise a series of ¾" plywood panels approximately 4' wide and 7½' high which provide the side panel platens which are aligned to match mounting holes with the vertical structural members inside the side wall of the containers. The platens are then fastened to the structural members by drilling holes and running screws through the platens into the structural member. Each platen may fasten to three vertical members. Ceiling platens are installed by raising them to position and supporting them with mechanical jack rods adjusted to exert sufficient tension to brace them from the floor to the ceiling without deflecting the ceiling panel.

The rear doors are shored by a sandwich device which combines a structural iron frame with platens attached. The sandwich is placed on each door and fastened to provide restraint to both interior and exterior door surface. The container of the unit with the interior shoring equipment is then moved to the foaming station. At this position, the external roof platen is lowered from overhead suspension and external side shoring section is applied. The container or unit is then foamed by moving the metering head from one end of the container to the other, successively inserting the discharge hose in the foam hole at each cavity, allowing the predetermined quantity of chemical to enter the cavity, then moving to the next hole. Each segment of the body is foamed completely, then the next segment, with the floor being formed first, then one side panel and rear door, then roof, then second side panel.

After foaming, the roof platen is raised and external forward side panel shoring is removed and moved to another station where the internal shoring is removed.

The total process as described is quite disjointed due to the distance between the shoring, foaming and deshoring positions. It further induces high labor costs due to the nature of the internal shoring and the time required for its positioning, installation and subsequent removal.

In other shoring arrangements, the internal and external shoring equipment is at one station with the walls of the container being moved between the internal and external platens before the shoring equipment is actuated to apply the required pressures or resistances. The main disadvantage of this arrangement is that the internal shoring equipment must be held in a fixed cantilever type suspension which requires a great amount of support at one end. This causes stresses to be built up in the equipment. It also causes misalignment problems which result from the sagging of the internal shoring parts.

OBJECTS OF THE INVENTION

It is an object of this invention to provide improved shoring methods and apparatus for reefer containers.

It is a further object of this invention to provide improved shoring apparatus for reefer containers in which the time and labor involved in performing the shoring operations are minimized.

It is still a further object of this invention to provide improved shoring apparatus in which the internal shoring apparatus is not subject to excessive strain or misalignments.

BRIEF SUMMARY OF THE INVENTION

Means and methods are provided for shoring the roof, side walls and floor of an open container to permit insulating material to be inserted under pressure into cavities therein to produce a reefer or refrigerated container. A first set of selectively movable housing members at a fixed station are disposed to receive the container to align the first shoring members and shore the external surfaces of the container. A second set of selectively movable shoring members to provide shoring of the internal surfaces of the container are connected to a movable assembly, mandrel, which is normally disposed on a fixed platform. The mandrel is selectively moved into the open area of the container to bring the second set of shoring members into alignment to shore the internal surfaces of the container.

Other objects and advantages of the present invention will be apparent and suggest themselves to those skilled in the art, from a reading of the following specification and claims, taken in conjunction with the accompanying drawings.

DETAILED DESCRIPTION OF THE INVENTION

In describing the present invention, the operations relating to the shoring of a container will be described. Various operations taken prior to and after the shoring operation will not be illustrated or described in detail.

In general, however, a container to be foamed is generally preheated. Following the preheating, masking tape is applied to protect the side panel sheets from the foam. The sides are generally covered with wide plastic sheets. Various front and rear side sheet foam holes and breath holes are drilled as required. Following the preliminary operations in the present invention, the container is transferred to a station including the outer shoring apparatus by means of a bridge crane.

Following the foaming operation after the internal and external shoring is removed, the container is removed from the foaming station by means of the bridge crane. Plastic sheets and masking tape are then removed and the exterior of the container is cleaned of excess foam.

Figure 1:
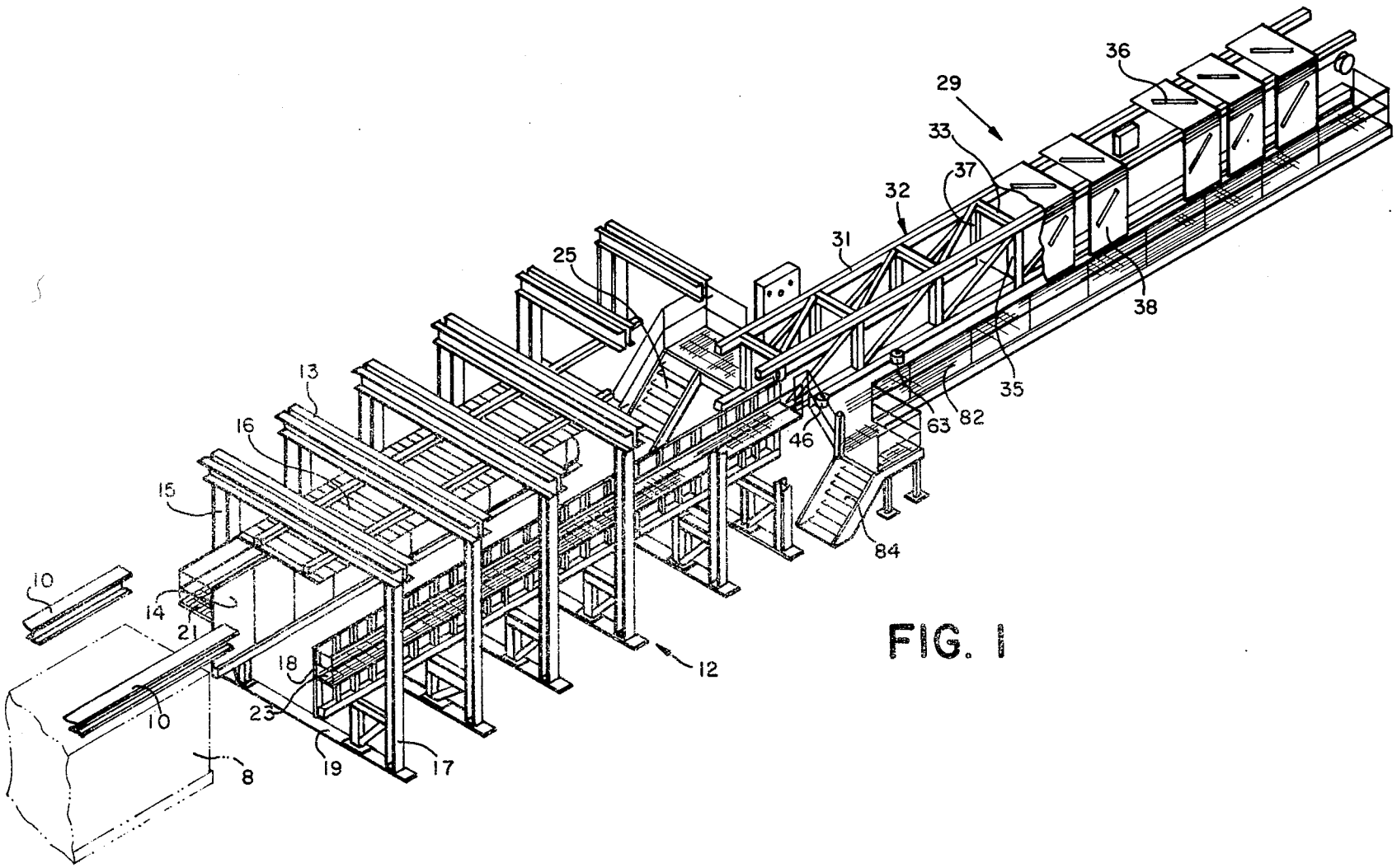
FIG. 1 is a perspective, somewhat schematic, view of a shoring system, in accordance with the present invention.

Referring particularly to FIG. 1, a container 8 to be foamed is transferred by means of crane transfer rails 10 to a fixed station 12 which is designed to provide the shoring for the external surfaces of the container 8. The fixed station comprises an open rectangular frame assembly having a plurality of spaced top structural beams 13, spaced vertical side beams 15 and 17 and spaced bottom base members 19.

The station 12 includes suitable platforms 21 and 23 to permit workers alongside of the container. Means for reaching the platforms are provided by steps 25. A plurality of sets of selectively movable shoring members or platens 14, 16 and 18 are suitably attached to the top beams 13 and side beams 15 and 17. The platens comprise sheets of solid material which cover wide areas and are used to provide pressure or resistance to prevent expansion of the surfaces which they contact.

A rear station 29 comprises an open rectangular frame or mandrel 32. The frame comprises longitudinal beams 31 having spaced top beam 33 and side beams 35 and 37 connected to suitable reinforcement members. The frame including the mandrel 32 normally rests on a fixed platform 39 (FIG. 3) which provides support between uses as when the mandrel 32 is in a retracted position as illustrated in FIG. 1. The platform 45 is supported by longitudinal beams 41 which rest on a lateral structural beams 43. The platform is disposed on a stand which is firmly based on the ground.

Figure 2:
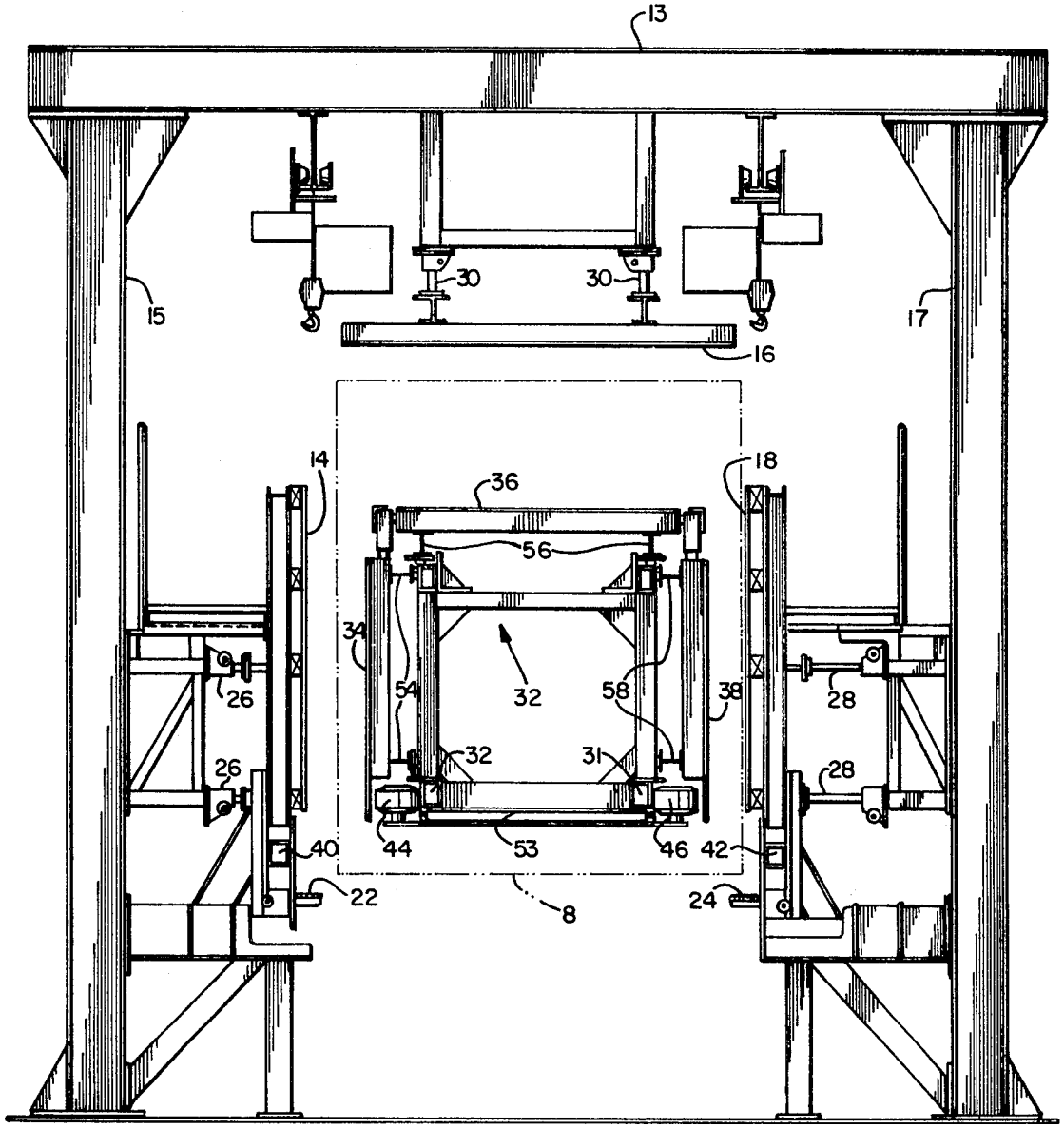
FIG. 2 is an end more detailed view of a system illustrated in FIG. 1 with the inner shoring apparatus suspended within the outer shoring apparatus.

As illustrated in FIG. 2, the container 8 is eventually set down on support members or forks 22 and 24. Various drive elements (not illustrated) may be employed to position the support members 22 and 24 beneath the container 8 before the container 8 is lowered.

After the container 8 is resting on the support members 22 and 24, the side platens 14 and 18 and roof platens 165 are moved against the external surfaces of the container 8 by suitable means. The means for driving the side platens 14 may include mechanical screw jacks 26. The side platens 18 may be driven by suitable screw jacks 28 and the top or roof platens 16 may be driven by screw jacks 30. Various switches, which may be tape switches or microswitches (not illustrated), may be employed to limit the expansions of the various platens 14, 16 and 18 against the external surfaces of the container 20. When the switches are operated, the motor which drives the various screw jacks are made inoperative.

When the container 8 is in position with all the external platens expanded against the exterior surfaces of the container in a conventional manner by conventional means, the level of the floor of the container is compared with the level of the platform 45, which forms part of the rear assembly from which the mandrel 32 is moved into the front assembly. The platform 45 and associated base structural members comprise strong stationary base for supporting the rear frame assembly including the mandrel 32. The mandrel 32 is adapted to be selectively moved in and out of the inner opening of the container 8.

A plurality of sets of selectively movable platens 34, 36 and 38 are suitably secured to the rear open frame assembly which comprise the mandrel 32. Means are provided for expanding the platens 34, 36 and 38 outwardly against the interior surfaces of the container 8 after the mandrel 32 has been moved within the opening of the container. The mandrel 32 is inserted after all of the external platens are in place against the outer surfaces of the container.

When the container 8 is in position with all of the external platens 14, 16 and 18 against the external surfaces of the container, the level of the floor of the container is checked with respect to the support platform 45 because this is the platform from which the mandrel 32 is moved or rolled onto the container. If the levels are different, the support members 22 and 24 are driven up or down, depending upon the desired direction by electric motors (not illustrated) which may drive screw jacks to change the elevation to level the trailer or container floor to the level of the support platform 45.

As illustrated in FIG. 2, the support members 22 and 24 are connected to beams 40 and 42, respectively. These support member 22 and 24 are approximately 16" long and there may be approximately eight of them along each side in a typical trailer container. The support members 22 and 24 are made in such a way that they may be slid along the beams 40 and 42 to clear various obstructions that may be hanging down from underneath the container.

When the external surfaces of the container 8 have been shored, the mandrel 32 is driven into the opening of the container 8. Four hydraulic motors are connected to drive four tire rolls. Only tire rolls 44 and 46 are illustrated in FIG. 2. FIG. 4 illustrates a pair of tire rolls 46 and 63 on one side. The means of driving are transmitted to the rubber tire rolls, which may be regular forklift tires pressed on suitable hubs. The various connections of the hubs to the hydraulic motors is not illustrated in detail because they are believed to be well known to those skilled in the art. Some additional details associated with the driving motors are illustrated in FIGS. 3 and 4.

Figure 3:
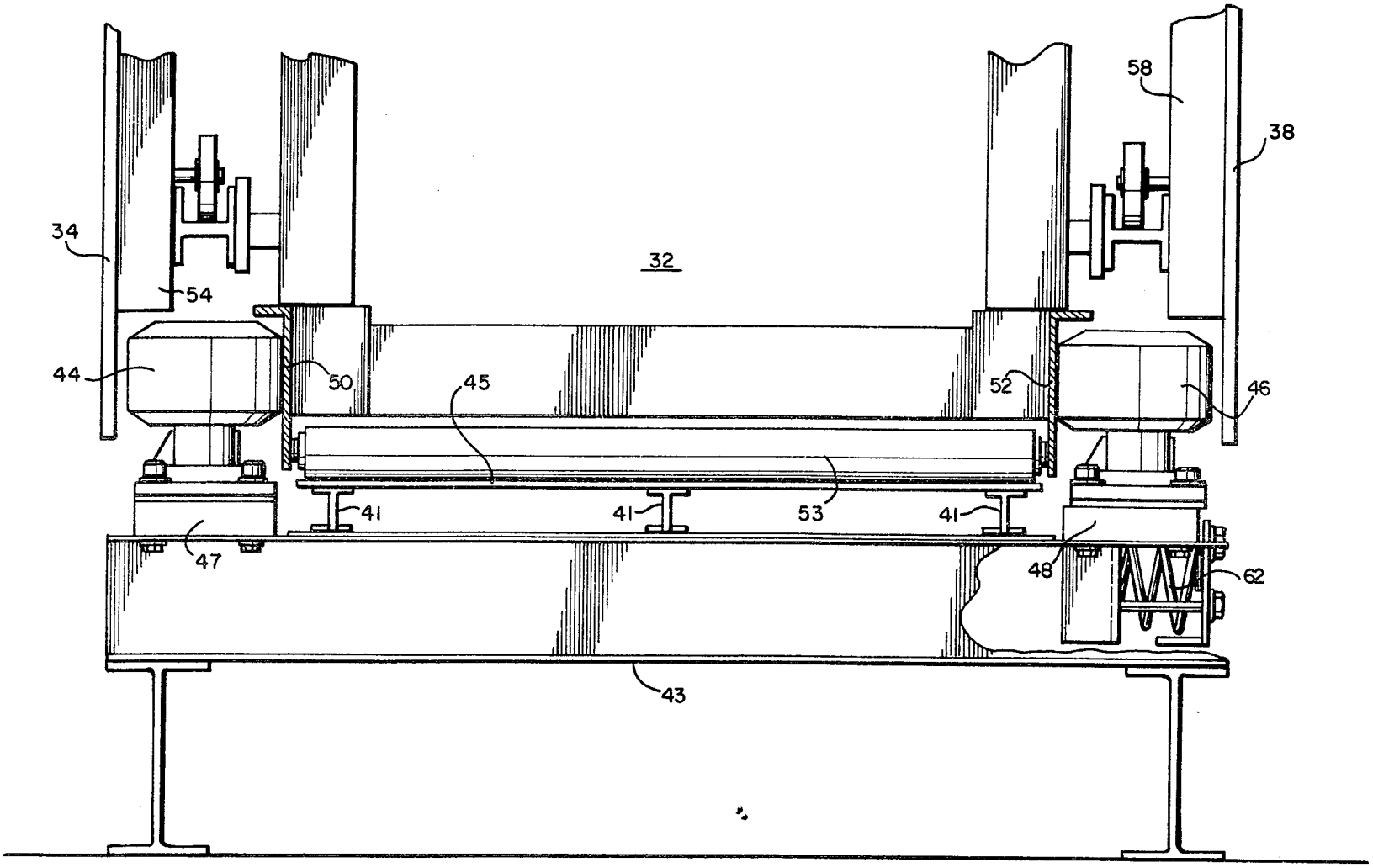
FIG. 3 is a partial end view, partly in cross-section and partly broken away, illustrating an enlarged portion of the inner assembly of FIG. 2 resting on a rear platform out of the inner shoring apparatus.
Figure 4:
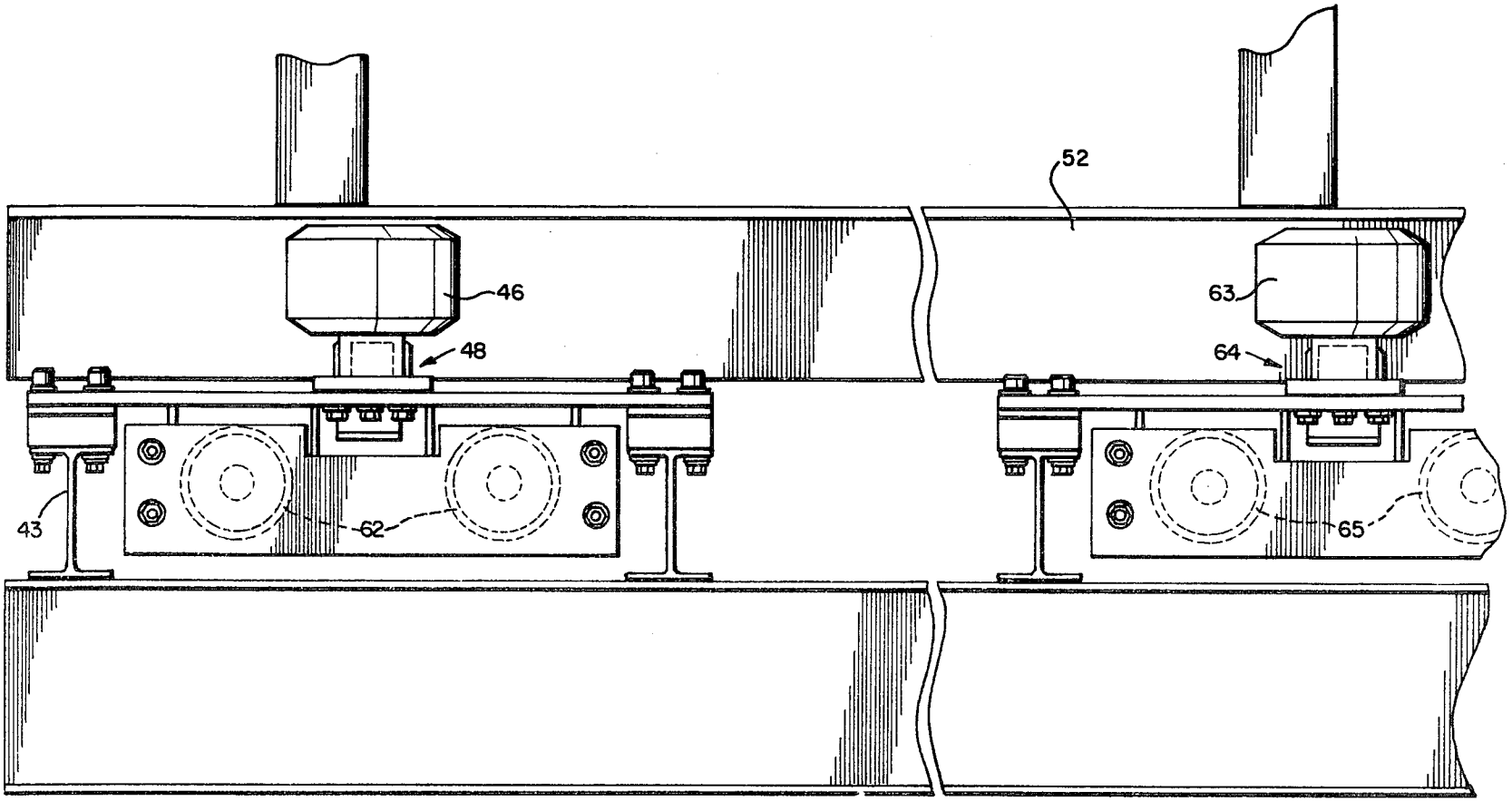
FIG. 4 is a side view, partly broken away, illustrating the drive system of FIG. 3 for moving the inner shoring apparatus in and out of the outer shoring apparatus.

Referring to FIGS. 3 and 4, along with FIGS. 1 and 2, motors 47 and 48 drive the tires 44 and 46, respectively, through suitable coupling means with motor 64 driving tire 63 in FIG. 4. The tires 44 and 46 (as well as the rear tires) make frictional contacts with side plates 50 and 52. The plates 50 and 52 run the entire length on both sides of the mandrel 32 and allow surface contact against the rubber tire rollers throughout the entire length.

The plurality of rollers 53 (also in FIG. 5) are connected to ride in journals in the side rails 50 and 52 connected to the bottom portion of the mandrel 32. The rollers 53 are on 12' centers and run the entire length of the movable mandrel 32. The rollers 53 roll off and on between the platform 45 and the container floor when the mandrel 32 is expanded and contracted.

The expandable platens 34, 36 and 38 on the mandrel or inner frame assembly 32 may be four foot long assemblies which are attached to the mandrel to expand and shore the ceiling and the side walls of the interior of the container 8. The platens may be driven by mechanical screw jacks which may be driven by electric motors. The means for pushing the platens are full length beams which may be beams such as beams 54, 56 and 58 (FIG. 2). There are two of these beams on both sides and two on the top.

As again illustrated in FIG. 3, the drive motors 47 and 48 are fixed directly to the ends of support beams such as the support beam 43. The drive motors which engage the side rail 52, such as the drive motor 48 is spring loaded by a spring arrangement 62. The motor 47 is maintained fixed in order to keep the mandrel 32 square to the external shoring. The spring loading is to take care of any undulation on the surface of the side rail 52. The spring loading also provides means for applying pressure to the sides of the mandrel frame to keep tension on the rollers. The spring means may be adjustable to enable the application of various tensions to eliminate various types of slippage.

As illustrated in FIG. 4, two side motors 46 and 64 of similar types are employed on both sides to drive wheels or tires 46 and 63 which engage the side rails 50 and 52. The use of four drive motors makes it possible to apply a large surface for driving the mandrel 32. The mandrel frame is also maintained square during the driving operation. Both motors 46 and 63 in contact with the rail 52 are spring loaded by similar spring arrangements 62 and 65.

Figure 5:
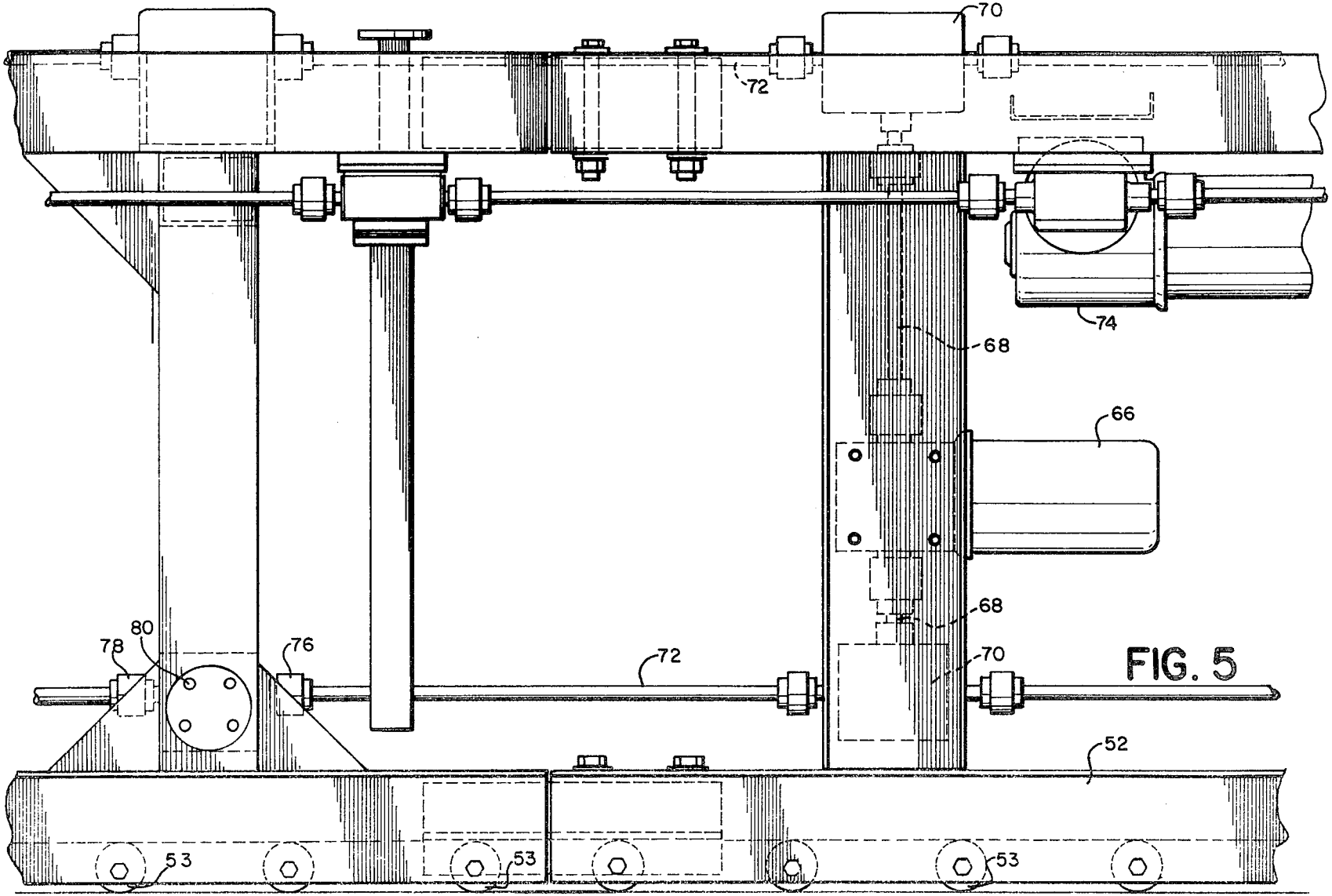
FIG. 5 is a side view illustrating a drive system for moving platen members to provide internal shoring and illustrating the rollers on which the inner shoring apparatus is selectively moved in and out of the outer shoring apparatus.

As illustrated in FIG. 5, the rollers 53 are spaced on 12" centers. The spacing is throughout the entire length of the mandrel 32 and is used to distribute evenly the load of the mandrel over the container floor once it is rolled onto the container. The rollers are fastened to the side rails 50 and 52 that drive the mandrel when the drive motors rotate the tires.

In addition to illustrating the rollers on the mandrel, FIG. 5 also illustrates one type of driving means for driving the side platens which may be used to selectively move the inner platen members. A motor 66 is a common drive motor for the side platen assemblies. The side platen assemblies are driven from the motor 66 through coupler shafts 68 to gear boxes 70. Shafts 72 are connected to a mechanical screw jack 80. Couplers 76 and 78 provide mechanical means to connect the shafting to the screw jack, such as the screw jack 74. The means for driving the platens are conventional and not directly related to the invention and therefore not shown or described in further detail. A drive motor 74 drives a top platen system in a similar fashion to that described.

The rear station from which the mandrel 32 is moved includes work platforms, such as platform 82 (FIG. 1) which may be reached by a worker by stairs 84.

The present invention, as mentioned, is directed towards providing a fixed station having a first set of outer platens for shoring up the external surfaces of a container. A second station includes movable mandrel having a second set of platens. The mandrel is adapted to be selectively driven off of a fixed relatively strong platform into the opening of the container so that the inner platens may be expanded to provide shoring for the internal surfaces of the container.

After the various platen have been expanded on the inside and outside surfaces of the container, the foam material is injected into the cavities between the walls of the container in conventional manner.

It is recognized that many of the elements mentioned in describing the present invention are well known to those skilled in the art. Therefore, such items as motors, screw jacks, and rollers have not been described in great detail. It is apparent that many other different items may be used to move a mandrel in and out of an opening of a container.

The main advantage of the present invention is that the mandrel 32 which includes the internal shoring platens is on a fixed platform of relatively high strength. Therefore, it will not be subjected to strain between foaming operations. Consequently, the drooping of the mandrel will not be a problem and the alignment of the floor of the container with respect to the mandrel is relatively easy to obtain.

Various items such as microswitches, levelling devices and the like are well known to those skilled in the art. For the purpose of clarity, details showing many of these items are not included.

What is claimed is:

1. Apparatus for providing external and internal shoring for the roof and side walls of an open container to permit foam material to be inserted under pressure into cavitites therein, comprising:

a. a first fixed station including first selectively movable shoring members;

b. said first station being disposed to receive said container with the external surfaces of said roof and side walls thereof in alignment with said first shoring members to permit external shoring thereof;

c. a second station including second selectively movable shoring members to provide internal shoring of the internal surfaces of said roof and side walls of said container;

d. said second station including movable mandrel disposed on a fixed platform for holding said second selectively movable members;

e. said movable mandrel comprising a rectangular open frame assembly including a pair of rail elements;

f. means for selectively extending said mandrel from said fixed platform into the open area of said container within said first station to bring said second shoring members into alignment with the interior surfaces of said roof and side walls of said container to permit shoring thereof, and g. said means for selectively moving said mandrel comprising drive wheels secured to said fixed platform in frictional engagement with said side rail elements and motor means for rotating said drive wheels to extend and retract said side rail elements and said frame assembly into and out of the open area of said container within said first station.

2. Apparatus as set forth in claim 1 wherein said second movable shoring members are secured to and around said open frame assembly, and motor means for selectively moving said second shoring members which are connected inside of said open frame assembly.

3. Apparatus as set forth in claim 2 wherein spring biasing means are provided to bias the drive wheels engaging one of said side rail members on said open frame assembly.

4. Apparatus as set forth in claim 3 wherein a plurality of spaced roller members are connected to the bottom of said open frame assembly to permit said mandrel to be rolled between said fixed platform and the floor of said container when said mandrel is expanded and retracted.

5. Apparatus as set forth in claim 4 wherein said motor means are provided at said first fixed station to expand and contract said first shoring members.

6. Apparatus as set forth in claim 5 wherein conveyor means are provided to carry said container into said first fixed station.

7. A method of shoring the external and internal surfaces of the side walls and roof of an open container with a floor to permit foam insulating material to be inserted under high pressures into cavities within said side walls and ceiling comprising the steps of:

a. providing a first fixed station having a first set of movable shoring members;

b. providing a second station having a fixed platform with a movable mandrel thereon with a second set of movable mandrels;

c. moving said container into said first station with the first set of movable shoring members in alignment with the external surfaces of said side walls and roof;

d. moving said first set of shoring members into contact with said side walls and roof;

e. extending said mandrel away from said fixed platform into the open area inside of said container to align said second set of shoring members with the internal surfaces of said side walls and roof;

f. said step of extending said mandrel comprising rolling said mandrel from said fixed platform on to said floor of said container, and g. moving said second set of shoring members into contact with the internal surfaces of said side walls and roof.

8. A method as set forth in claim 7 wherein an additional step is provided of levelling said floor of said container with said fixed platform prior to the step of extending said mandrel.

* * * * *